United States Patent [19]

Jacobson et al.

[11] 3,952,798

[45] Apr. 27, 1976

[54] INTERNALLY HEATED HEAT PIPE ROLLER

[75] Inventors: Dean L. Jacobson, Monrovia; Randolph W. Hamerdinger, Glendora, both of Calif.

[73] Assignee: Xerox Corporation, Stamford, Conn.

[22] Filed: Aug. 31, 1970

[21] Appl. No.: 68,299

[52] U.S. Cl. ..... 165/105; 165/89; 122/366; 219/471

[51] Int. Cl.[2] ..... F28D 15/00

[58] Field of Search ..... 165/105, 89; 122/366; 219/469–470

[56] References Cited

UNITED STATES PATENTS

| | | | |
|---|---|---|---|
| 1,987,119 | 1/1935 | Long | 219/325 |
| 3,327,772 | 6/1967 | Kodaira | 165/105 X |
| 3,414,475 | 12/1968 | Fiebelmann | 165/105 X |
| 3,431,396 | 3/1969 | Kodaira | 165/105 X |
| 3,490,718 | 1/1970 | Vary | 165/105 |
| 3,548,930 | 12/1970 | Byrd | 165/105 |
| 3,603,382 | 9/1971 | Paine | 165/105 |
| 3,603,767 | 9/1971 | Scicchitano | 165/105 X |

*Primary Examiner*—Albert W. Davis, Jr.
*Attorney, Agent, or Firm*—J. E. Beck; T. J. Anderson; Irving Keschner

[57] ABSTRACT

A heat pipe is provided with an internally positioned heat source.

4 Claims, 3 Drawing Figures

INVENTORS:
Dean L. Jacobson
BY Randolph W. Hamerdinger
Irving M. Kriegman
ATTORNEY.

INTERNALLY HEATED HEAT PIPE ROLLER

This invention relates to heat pipes. More particularly, this invention relates to an internally heated heat pipe roller.

A heat pipe is a well known heat transfer device having no moving parts and capable of transporting large quantities of heat at high efficiencies.

In its simplest form, a heat pipe consists of an elongated closed container whose inner walls are lined with a porous wick structure that is saturated with a volatile fluid. In the operation of the device, heat is put into the container at one location, called the evaporator section, and is removed from the container at another location, called the condenser section. Usually the evaporator section is at one end of the container and the condenser section is at the other end of the container.

Heat pipes are disclosed in many U.S. patents, such as U.S. Pat. No. 3,435,889, U.S. Pat. No. 3,498,369, U.S. Pat. No. 3,516,487 and U.S. Pat. No. 3,502,138 and in many publications such as an article entitled "The Heat Pipe" by G. Yale Eastman appearing in the May, 1968, issue of Scientific American, pages 38 – 46, an article entitled "The Heat Pipe" by K. Thomas Feldman and Glen H. Whiting appearing in the February, 1967, issue of Mechanical Engineering, pages 30 – 33, an article entitled "Heat Pipes - A Cool Way to Cool Circuitry" by C. H. Dutches, Jr. and M. R. Burke appearing in the Feb. 16, 1970, issue of Electronics and an article entitled "Heat Pipes and Their Application to Thermal Control in Electronic Equipment" by Thomas D. Sheppard, Jr. appearing in the Proceedings of Nepcon West dated Feb., 1969, pages 25 – 51.

A heat pipe can be combined with a heat source and used to supply heat to an object or workpiece. Hitherto, this has been achieved by simply positioning the heat pipe next to the heat source. It has been found that when heat is transferred from the heat source into the heat pipe a certain amount of heat is lost since in order to reach the inside of the heat pipe the heat must first pass through the sidewalls of the heat pipe and then through the porous wick structure.

It is an object of this invention to provide a new and improved heat pipe.

It is another object of this invention to provide a heat pipe in the form of a roller.

It is still another object of this invention to provide a heat pipe which includes a heat source.

It is yet still another object of this invention to provide an efficient technique for transferring heat from a heat source to a heat pipe.

It is another object of this invention to provide a heated heat pipe in the shape of a roller wherein the heat is coupled out through the sidewalls of the roller.

According to this invention, the above and other objects are achieved by providing a roller shaped heat pipe which includes an internally positioned heat source. Many features and attendant advantages of the invention will become apparent on reading the following detailed description when taken in connection with the accompanying drawings in which like reference numerals represent like parts and wherein.

Figure 2:
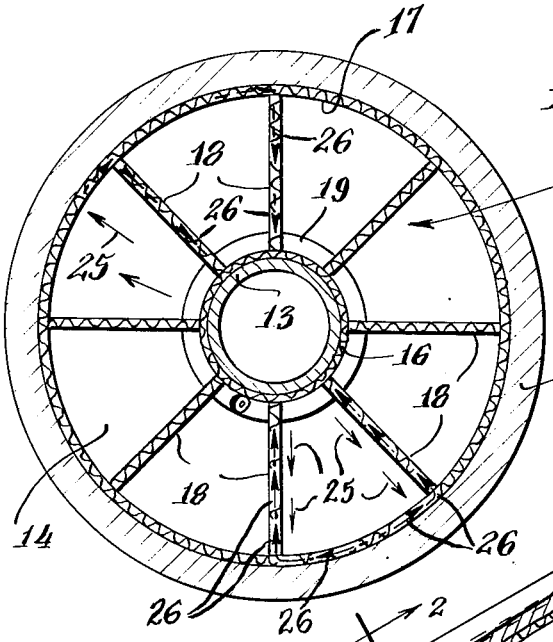
FIG. 2 is an enlarged section view taken along lines 2—2 of FIG. 1.
Figure 1:
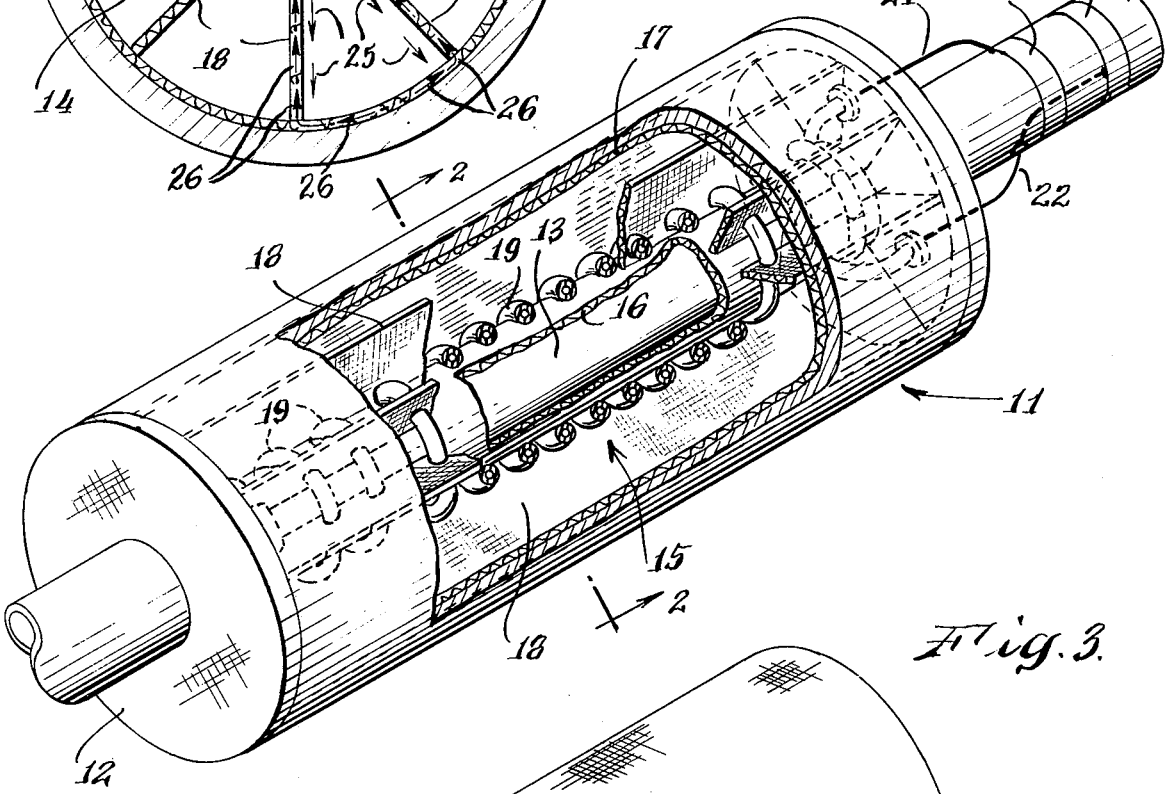
FIG. 1 is a perspective view partly broken away of a heat pipe constructed according to this invention.
Figure 3:
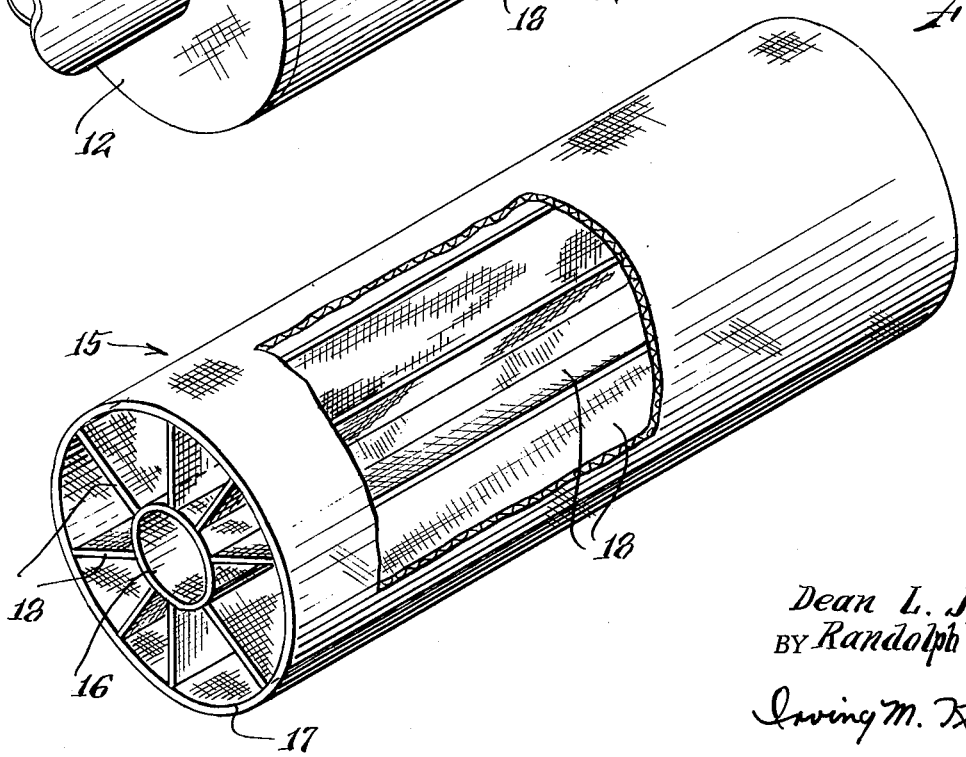
FIG. 3 is a perspective view partly broken away of the porous wick structure portion of the heat pipe shown in FIG. 1.

Referring to the drawings, there is shown a heat pipe 11 constructed according to this invention. The heat pipe 11 includes a hollow cylindrical drum 12 rigidly mounted on a hollow supporting shaft 13, the space inside the drum 12 defining an evacuated gas tight chamber 14. The shaft 13 passes through the drum 12 along its longitudinal axis and extends out through the ends of the drum 12. Mounted in the chamber 14 is a porous wick structure 15 saturated with a suitable working fluid. The porous wick structure 15 is made up of an inner cylindrical section 16, an outer cylindrical section 17 and a plurality of connecting rib sections 18. Inner cylindrical section 16 is sized and positioned inside the drum 12 so as to form a sleeve around the shaft 13, outer cylindrical section 17 is sized and positioned inside the drum 12 so as to form a liner about the inner sidewalls of the drum 12 and connecting rib sections 18 are sized and positioned so as to extend outward radially from the inner cylindrical section 16 to the outer cylindrical section 17. Wound over cylindrical section 16 and extending through rib sections 18 is a heater coil 19 which is connected by leads 21, 22 to slip rings 23, 24 on one end of the shaft 13. Slip rings 23, 24 are electrically coupled by brushes (not shown) to an external power supply (also not shown).

In the operation of the heat pipe 11, the space around the center of the drum 12 (i.e., the space around the shaft 13) functions as the evaporator section and space around the inner sidewalls of the drum 12 functions as the condenser section. Heat supplied to the chamber 14 by the heater coil 19 causes the working fluid in the porous wick structure 15 to vaporize. The vapor, carrying heat along with it, moves from the evaporator section to the condenser section as shown by the solid arrows 25. At the condenser section the heat is coupled out of the chamber 14 through the sidewalls of the drum 12 causing the vapor to condense back to a fluid. Through capillary action, the condensed fluid is transported back through the porous wick structure 15 to the evaporator section as shown by the dotted arrows 26.

The drum 12 and the porous wick structure 15 can be made of conventional heat pipe materials and the working fluid can be any one of the known volatile fluids used in heat pipes. For example, the drum 12 can be made of aluminum, the porous wick structure 15 can be made of aluminum mesh and the working fluid can be water.

The heater coil 19 is preferably made of an insulated type heater wire, such as Nichrome.

One of the important features of this invention is that the heat source is located inside the heat pipe chamber. By having the heat source inside the heat pipe chamber, heat losses that would occur when transferring heat from the heat source to the heat pipe chamber if the heat source were located outside the heat pipe chamber are avoided.

The heat pipe of this invention has a wide variety of potential and actual uses and applications. For example, the heat pipe can be used in xerographic copying equipment, such as disclosed in U.S. Pat. No. 3,301,126, U.S. Pat. No. 3,062,109, U.S. Pat. No. 3,099,943 and U.S. Pat. No. 3,180,637, as the heat fusing roller for affixing the powdered image to the support surface or as a device for heating the heat fusing roller.

What is claimed is:

1. An internally heated heat pipe for heating the outer surface of the heat pipe substantially uniformly over the length thereof comprising:

a. a container comprising a cylindrical side wall and two end walls for providing a closed space, said side wall having inner and outer surfaces, b. an elongated member positioned within said container and extending substantially parallel to the axis of said container, c. a wick structure comprising first, second and third portions, said first wick portion overlying said elongated member, said second wick portion overlying the inner surface of said side wall, said third wick portion extending in a radial direction from said first wick portion to said second wick portion, said first, second and third wick portions being saturated with a heat transer fluid, said heat transfer fluid being vaporized when a predetermined amount of heat is applied thereto, and d. means for applying heat to said heat transfer fluid in an amount sufficient to vaporize said heat transfer fluid, said heat applying means overlying said first wick portion, the heat in said vapor being transferred substantially uniformly to said outer side wall surface along the length thereof.

2. The heat pipe as defined in claim 1 wherein the length of said elongated member is substantially equal to the length of said container.

3. The heat pipe as defined in claim 2 wherein said heat applying means extends over the length of said first wick portion.

4. The heat pipe as defined in claim 2 wherein said heat applying means comprises an elongated coil surrounding said first wick portion.

* * * * *

UNITED STATES PATENT AND TRADEMARK OFFICE

CERTIFICATE OF CORRECTION

PATENT NO. : 3,952,798

DATED : April 27, 1976

INVENTOR(S) : Dean L. Jacobson and Randolph W. Hamerdinger

It is certified that error appears in the above-identified patent and that said Letters Patent are hereby corrected as shown below:

Claim 4, line 1, delete "2" and insert --3--.

Signed and Sealed this

Thirtieth Day of November 1976

[SEAL]

*Attest:*

RUTH C. MASON
*Attesting Officer*

C. MARSHALL DANN
*Commissioner of Patents and Trademarks*